US005979812A

United States Patent [19]

Kotzur et al.

[11] Patent Number: 5,979,812

[45] Date of Patent: Nov. 9, 1999

[54] COIL WITH LARGE PAYOUT HOLE AND TUBE FOR KINKLESS PAYOUT

[75] Inventors: Frank W. Kotzur, Carmel; Aaron B. Harmon, Hopewell, both of N.Y.

[73] Assignee: Windings, Inc., Patterson, N.Y.

[21] Appl. No.: 09/063,278

[22] Filed: Apr. 21, 1998

[51] Int. Cl.[6] ..... B65H 55/02; B65H 57/12

[52] U.S. Cl. ..... 242/163; 206/409; 242/588.4

[58] Field of Search ..... 242/163, 174, 242/588.3, 588.4, 176; 206/409, 408, 395, 396

[56] References Cited

U.S. PATENT DOCUMENTS

| | | | |
|---|---|---|---|
| 2,767,938 | 10/1956 | Taylor | 242/163 |
| 3,178,130 | 4/1965 | Taylor | 242/163 |
| 4,057,203 | 11/1977 | Newman et al. | 242/163 |
| 4,057,204 | 11/1977 | Zajac | 242/163 |
| 4,373,687 | 2/1983 | Zicko | 242/163 |
| 4,406,419 | 9/1983 | Kotzur | 242/163 |
| 4,523,723 | 6/1985 | Kotzur | 242/163 |
| 5,150,789 | 9/1992 | Bass | 242/163 |
| 5,150,852 | 9/1992 | Hunt et al. | 242/163 |
| 5,470,026 | 11/1995 | Kotzur | 242/163 |
| 5,499,775 | 3/1996 | Vander Groef | 242/163 |
| 5,678,778 | 10/1997 | Kotzur et al. | 242/483.8 |

*Primary Examiner*—John M. Jillions

*Attorney, Agent, or Firm*—Laubscher & Laubscher; R. J. Lasker

[57] ABSTRACT

A payout tube for enabling payout of filamentary material having inherent twist characteristics from a coil of the filamentary material wound in a figure 8 configuration with a payout hole extending from the inner layer to the outer layer of the coil, wherein the payout hole has an oval or diamond shape; an inner end of the payout tube being adapted for insertion into the payout hole and having an oval or diamond shape corresponding to the oval or diamond shape of the payout hole, the payout hole having a diameter of at least ninety degrees; the payout tube having an inner diameter increasing in size from the inner end to the outer end thereof; and a collar formed around the outer end to support the payout tube against the outer surface of a container. The container may have a hingeable panel, the panel including a diamond or oval-shaped opening; the payout tube being formed of container-type material and having an outer end opening conforming to the diamond or oval-shaped panel opening, and a flap member extending from each of the sides of the diamond or oval-shaped opening and extending through and around the edges of the diamond or oval-shaped panel opening for supporting the payout tube with the panel in a closed position; the payout hole in the wound coil having a diamond or oval-shaped opening with a diameter greater than ninety degrees; and the payout tube having an inner end having a diamond or oval-shaped opening for extending into the diamond or oval-shaped opening of the payout hole.

20 Claims, 5 Drawing Sheets

52
64
57
50
60
58
59
56
62

40
41
42

86
86
70
83
72
78
84
83
74
85
80
76
83
87
84
87
82

COIL WITH LARGE PAYOUT HOLE AND TUBE FOR KINKLESS PAYOUT

BACKGROUND OF THE INVENTION

1. Field of the Invention

This invention relates to the winding of coils of filamentary material in a figure 8 pattern on a mandrel and paying out the wound filamentary material through a payout tube inserted through a payout hole in the wound coil extending from the inner to the outer coil thereof and through a payout hole in a wall of a container without introducing kinks or twist in the paid out filamentary material. More particularly, this invention relates to such winding techniques providing twistless payout of types of filamentary material having inherent twist, usually formed during manufacture of the filamentary material, such as CAT 5 and CAT 7 cable.

2. Related Art

The REELEX (a trademark of the assignee, windings, of the subject application) system of coiling, which consists of a winding of figure 8s distributed radially around a mandrel and providing a radial hole extending from the inner to the outer coil and through which the coiled filamentary material is to be withdrawn (see U.S. Pat. No. 4,406,419), works properly if the filamentary material has little or no inherent twist in it. However, If the filamentary material has inherent twist, the payout will not perform properly because the loops of the figure 8's must be free compensate one another, thereby canceling the twist caused by each other. If this compensation does not occur, then loops that contain twist will come free of the payout tube winding wall and cause tangles. This occurs when winding cables with twist winding lays that are very close, as for example, with the higher data rate cables.

SUMMARY OF THE INVENTION

A solution to the aforementioned problem of twist in impeding payout is to produce a coil with a payout hole large enough to allow room for the inherent twist in the material to exit the container in which the wound coil is stored.

Another advantage of the present invention in producing such a large payout hole is that the figure 8 loops do not have to become as small before exiting the payout tube because the exit point of the payout from the payout hole is free to move.

The size of the payout hole must be large enough to allow the twists to exit the payout hole and tube. It has been observed that, during the cable manufacturing process, twist is introduced into the cable, and during payout, the cable will take on a sort of cork screw set so that it has difficulty exiting a payout tube that is, say 1 inch, in diameter. When this occurs, the cork screw effect will twist back into the center of the coil because the loop that needs to exit can not flip to the proper side of the coil to cancel the cancellation of the twist. At times the twist in the filamentary material is so large that the next loop to exit the package is forced into the path of the loop that is currently exiting and a tangle occurs, or as often happens, a kink occurs.

These problems can also cause degadation of the electrical characteristics of the cable as well as the loss of time in removing the tangle or kink.

Although a coil can be produced with a small payout hole, and, then the hole can be made physically larger by forcing it open by hand or a tool of some kind, it is better to initially produce the hole so that it is the proper size to accept the payout tube. Forcing the hole open will damage the cable because of stretching and bending.

However, there are times that the payout hole can not be made as large as needed. For this condition a payout tube other than round is discussed herein, but in any case, the payout hole must be produced large. The production of a coil with such a large payout hole can create problems during the winding process because the room on either side of the hole is limited (Areas A of FIG. 1). The coil can be "lumpy", and it is certainly larger (because there is less circumference available for cable).

Moreover, the use of properly shaped endforms is important because, without the proper side supports for the coil, the hole can be forced closed, or the cable strands will not be placed properly and the hole will collapse. The aforementioned Windings' patent predicts the proper dimensions for these devices.

BRIEF DESCRIPTION OF THE DRAWINGS

The above objects, features and advantages of the invention may be readily perceived from the following description of the best mode of carrying out the invention when taken in conjunction with the following drawings, wherein:

FIG. 7A represents a coil with a 40 degree payout hole with a 1 inch OD payout tube;

FIG. 7B represents a coil having a hole of 110 degrees using a round payout tube/guide of approximately 2.75 inches;

FIG. 7C represents a coil that has a hole of 110 degrees and using a diamond-shaped payout guide; and FIG. 7D represents a coil having a hole of 110 degrees using a generally oval-shaped guide.

DETAILED DESCRIPTION

In the following description, a "nominal" size payout tube or payout hole refers to the size (diameter) of the payout hole or payout tube that is formed for filamentary material having little or no twist characteristics in accordance with the winding techniques disclosed in U.S. Pat. Nos. 5,678,778) High Speed, Dual Head, On-Line Winding Apparatus, 5,470,026, Uniform Width Payout Hole and 4,406,419, Method and Apparatus for Winding Flexible Material and assigned to Windings, Inc. the assignee of the present application. The respective disclosures of these patents are incorporated herein by reference. In accordance with the principles of the present invention, the payout hole is produced in the wound coil by producing a payout hole of ninety degrees (90) or larger. In present day state of the art winding machines that have digital input controls, the size of the hole (in degrees) may simply be dialed as an input to the winding machine control and the winding process will produce a payout hole having the dialed-in diameter.

CYLINDRICAL-SHAPED PAYOUT HOLES/ TUBES

Unless corrections are made during the normal REELEX winding process such as set forth in Windings' U.S. Pat. Nos. 4,406,419 and 5,678,778, for example, a payout hole having a diamond shape rather than a circular shape will be produced. However, as disclosed in Windings' U.S. Pat. No. 5,470,026, a payout hole having a substantially constant diameter may be produced. As set forth in the description of this patent, a constant diameter coil results in eliminating or reducing "valleys" and lumpiness of wound coils. Commensurate with the decrease in the lumpiness of the wound coil is a reduction in the overall diameter of the wound coil (for a given wind), thereby resulting in a decreased overall diameter coil that can be packaged in a smaller container. Finally, maintaining the desired diameter payout hole results in a smaller circumference wind, thereby also attributing to a smaller diameter coil because increasing the size of the payout hole diameter as the coil is wound causes increasing circumference of the wind.

The REELEX winding process normally does not produce twist in the wound coil; however, such a winding process does not eliminate or reduce the inherent twist in certain filamentary materials such as CAT-type cables, for example. Thus, it is necessary to account for the twist in wound coils with such twist-inherent filamentary materials when a wound coil of such filamentary material is being unwound through the payout hole and payout tube.

Figure 2A:
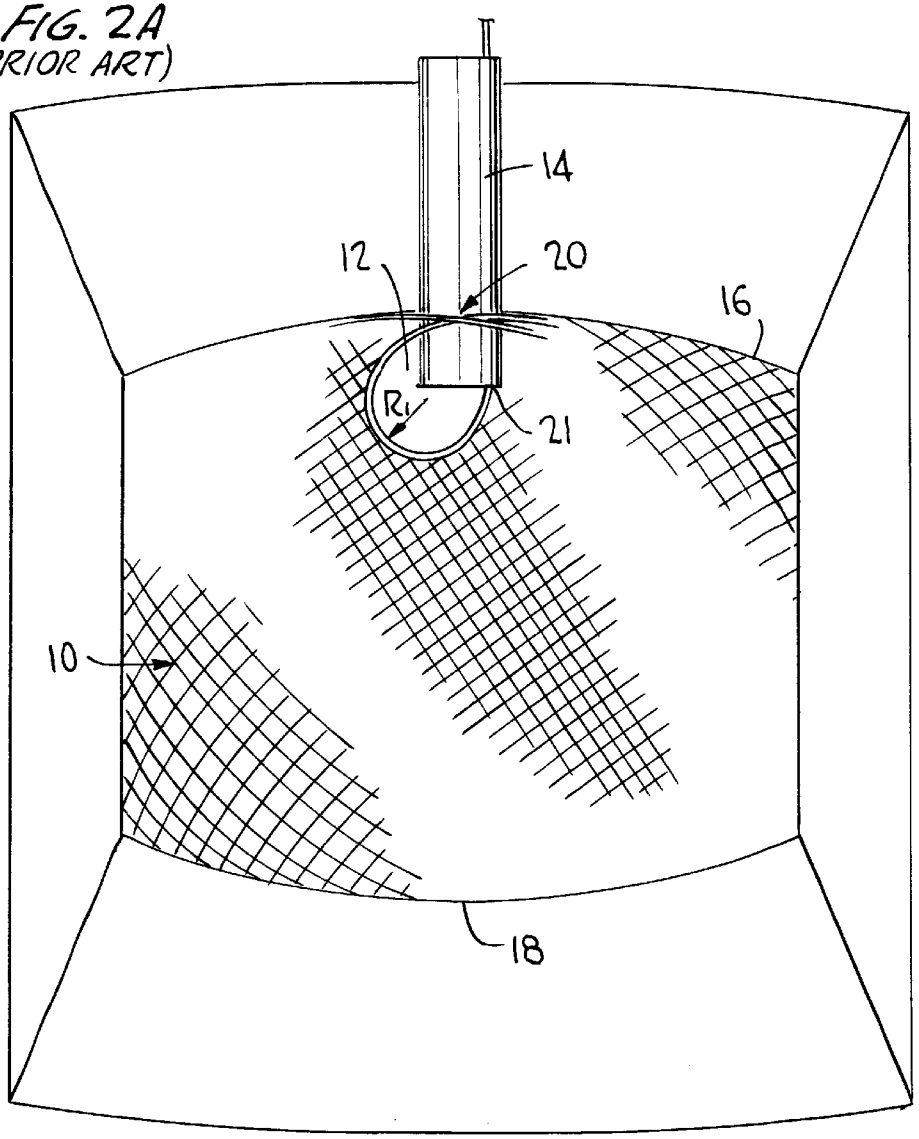
FIG. 2A (PRIOR ART)
FIG. 2A shows a coil produced with a nominal payout hole in accordance with the prior art and is normally produced to accept a payout tube of nominally 1 inch outside diameter and is characterized by a small bend radius $R_1$ because the crossovers are near the center of the payout hole/tube and the payout hole exit point is constrained to a small area.

FIG. 2A shows a wound coil 10 with a payout hole 12 that will accept a payout tube 14 of 1 inch diameter that is normally produced for filamentary material having little or no twist characteristics. The coil 10 is wound on a curved surface mandrel 16 of 8 inches at its center 18 and will require a payout hole opening of at least 42 degrees. The crossovers 20 nearest the tube 14 need to have a bend of relatively small radius to exit the payout tube 14. Normally if the forces generated on the coil 10 as a result of payout of the wound coil become large enough, the loops (not shown) of the figure 8's for such crossovers will move toward the center 18 of the wound coil 10 and relieve the torsion.

However, if the wound coil of filamentary material (cable) has sufficient twist in it, the wound coil or cable may move toward the payout tube 14 instead of away from it. The crossovers 20 nearest the payout tube 14 need to make a bend of relatively small bend radius $R_1$ to exit the payout tube. Normally, if the payout forces become large enough, the loops of the figure 8's for these crossovers will move toward the center 18 of the coil and relieve the torsion on the wound coil 10. However, if this happens, the bend radius $R_1$ of the loop will become quite small, which can damage some coil or cable products, and the twist will be backed up into the center 18 of the wound coil 10 where it will cause a tangle or kinking of the coil or cable.

In summary, FIG. 2A illustrates that the bend radius $R_1$ is small because (1) the crossovers 20 are near the center of the payout hole/tube (perhaps as close as 21 degrees): and (2) the payout hole exit point (21) is constrained to a small area.

Figure 2B:
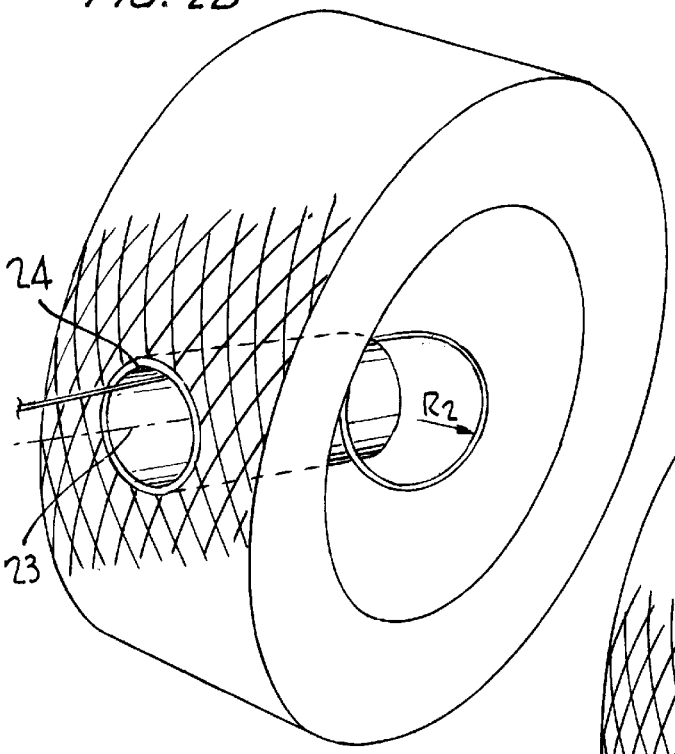
FIG. 2B shows a coil produced with a large payout hole in accordance with the invention and wherein the bend Radius $R_2$ is larger because the crossovers are farther away from the center of the payout hole/tube and the payout exit point can move farther away from the crossover, which effectively moves the "center" of the payout point.

FIG. 2B illustrates a coil produced with a large payout hole in accordance with the invention. Bend radius $R_2$ is larger because (1) the crossovers (22) are further away from the center 23 of the payout hole/tube (at least 45 degrees); and (2) the payout exit point 24 can move farther away from the crossovers 22, which effectively moves the "center" of the payout point. Finally, the distance from the crossover and the exit point is effectively increased to perhaps 70 degrees.

Figure 3A:
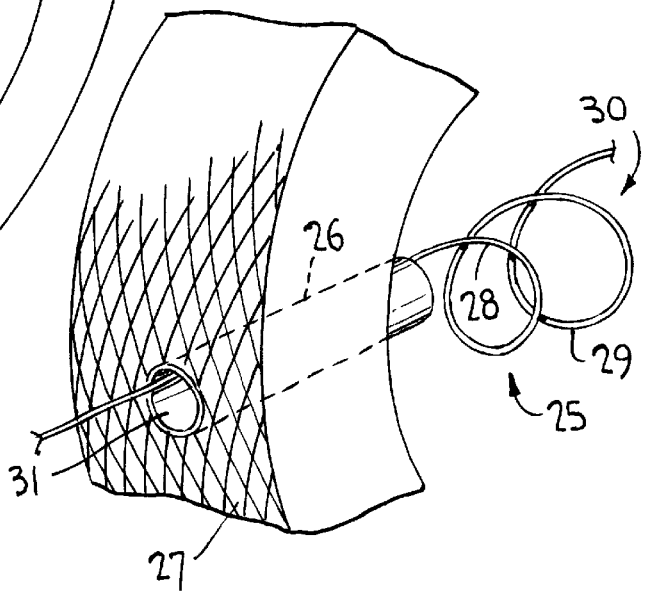
FIG. 3A PRIOR ART
FIG. 3A shows the concept of the cork screw effect produced in filamentary material during the unwinding process and shows how the loops may have trouble exiting a payout hole and tube of nominal diameter as opposed to one of a larger diameter in accordance with the invention.
Figure 3B:
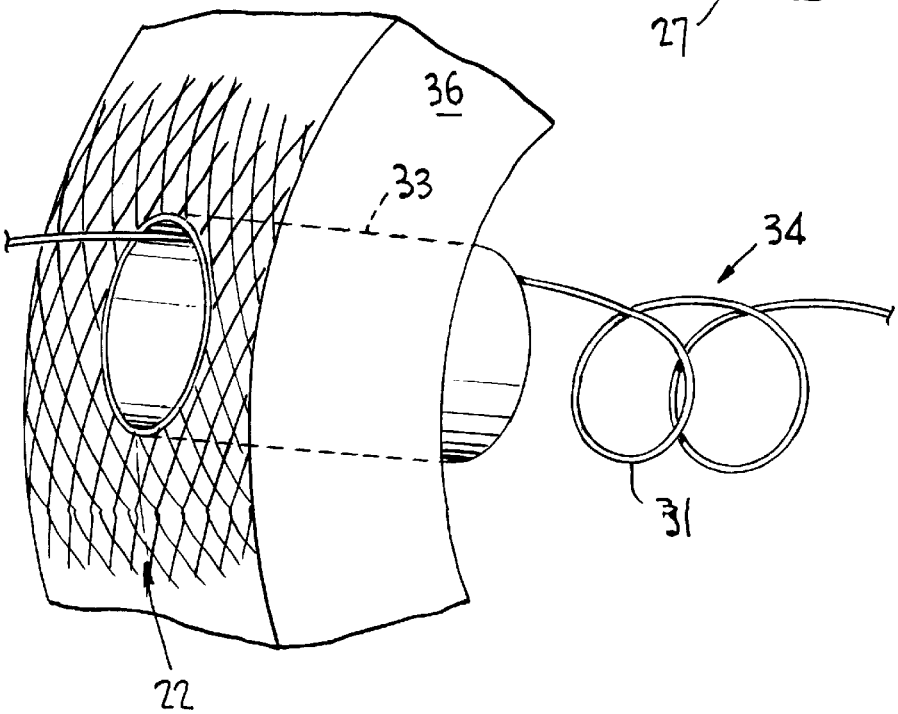
FIG. 3B illustrates a larger than nominal payout hole and tube in accordance with the invention and which enables the loops of twist in the filamentary material to exit the package.

FIG. 3A shows the concept of the cork screw effect produced by paying out coil or cable material that has a tendency to twist and how the loops 25 in the coil or cable 30 being unwound may have trouble exiting a payout tube 26 of nominal diameter as opposed to one of a larger than nominal diameter in accordance with the invention as shown in FIG. 3B. In FIG. 3A, when the coil or cable 30 is drawn out through the payout tube 26, if the twist 25 can not exit the package 27, the loop 28 will either pull down into a small loop and "kink", thereby causing damage to the coil or cable, or as the coil or cable rubs on the tube 26, the loop 28 will remain in the package 27, leaving the twist 25 there to add to the twist 29 that is behind it. If the small loop 28 causes the coil or cable 30 to rub against the payout tube 26 with enough force a "set" will develop in the coil or cable, much the same way as a piece of paper (or wire) will curl up if run over an edge. In severe cases the inherent twist or even the backed up twist will cause a tangle and will not pay out of the package at all as the knot will be bigger than the opening of the payout tube.

FIG. 3B shows the same cork screw concept as in FIG. 3A except that the payout hole 32 and payout tube 33, are much larger than the corresponding payout hole 31 and payout tube 26 of FIG. 3A. In this case it can be seen that the loops of twist 34 can exit the package 36 through the payout tube 33. If the twist does not exit the package 36 and a loop 37 develops in front of the payout tube 33, the loop 37 exits anyway without "kinking" or developing dangerous torsion forces.

The coil twists 22 and 34 respectively shown in FIG. 3A and 3B represent the twists that are an inherent part of the coil or cable and not produced by the package itself. Since REELEX technology produces a figure 8 package, it does not introduce a net twist during payout.

The large diameter payout tube and payout hole according to the invention serves several functions.

1) It keeps the crossovers further away from the exit hole in the wound coil or cable, thereby limiting the radius of the loops that develop near the payout hole.

2) It allows any "backed-up" twist that develops a way to exit the package.

3) It allows the payout exit point the freedom to move away from the crossover or a developing loop. With a smaller diameter payout tube the exit point is essentially fixed so the crossover must move. If the crossover does not move, the figure 8 loop can become quite small.

4) Because the payout smoothness is so greatly enhanced there is little force on the payout tube during payout. This increases the options available for the material that can be used for producing the payout tubes. Tubes made from molded paper pulp and die cut cardboard or corrugated paper board have all been used with success.

PAYOUT HOLE/TUBE SHAPES OTHER THAN CYLINDRICAL

Figure 1:
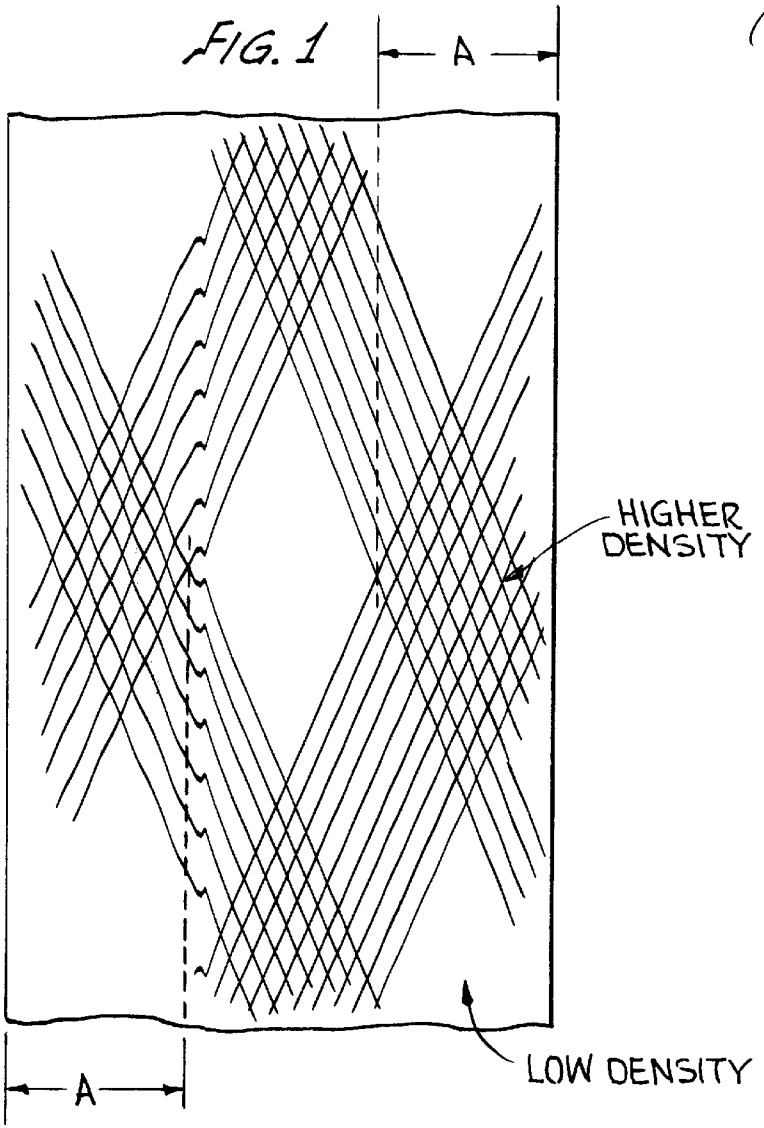
FIG. 1 is a plan view of section of a wound coil and illustrating the different density of wound coils resulting from the production of a wound coil having a large payout hole.

As can be seen from FIG. 1 the payout hole produced by the REELEX method of winding, as exemplified by the aforementioned U.S. patents, is already diamond-shaped and nothing special needs to be done to produce such a shape. Until recently the payout tubes have all had a round cross-section. As described above, by making the payout hole larger than nominal and using a large diameter (round) payout tube, the distance, in degrees, between the exit point and where the cross-over nearest the hole is greatly increased. Using an oval shape can increase this distance even more. The diamond and oval-shaped guides are similar to each other except that the corners are rounded in the case of oval-shaped guides/tubes.

What makes the diamond-shaped guide/tube interesting is that it can be made without expensive molding equipment and can be made from the waste portions of the corrugated material that is used to make the box for the coil.

Figure 4:
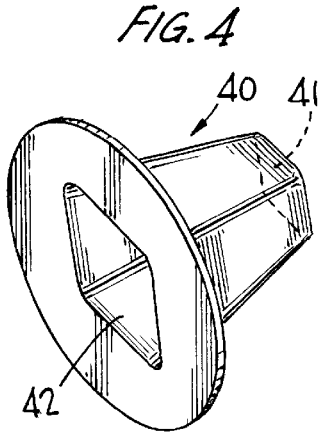
FIG. 4 illustrates a second embodiment of the invention in which the shape of the payout tube is other than round, i.e. oval in shape and is larger than a nominal payout tube.

FIG. 4 shows a payout tube 40 that is generally oval in shape. Because the payout holes 41, 42 are much longer than wide, an oval shape has proven to be an improvement than that of a circular shape for some products because it allows even more freedom for the exit point to move away from the crossovers nearest the payout hole and keeps the crossovers nearest the payout hole from moving during shipment and use of the wound coil or cable.

All of the molded payout tubes have a generous radius at the "mouth" that helps smooth out the payout even further.

Figure 5:
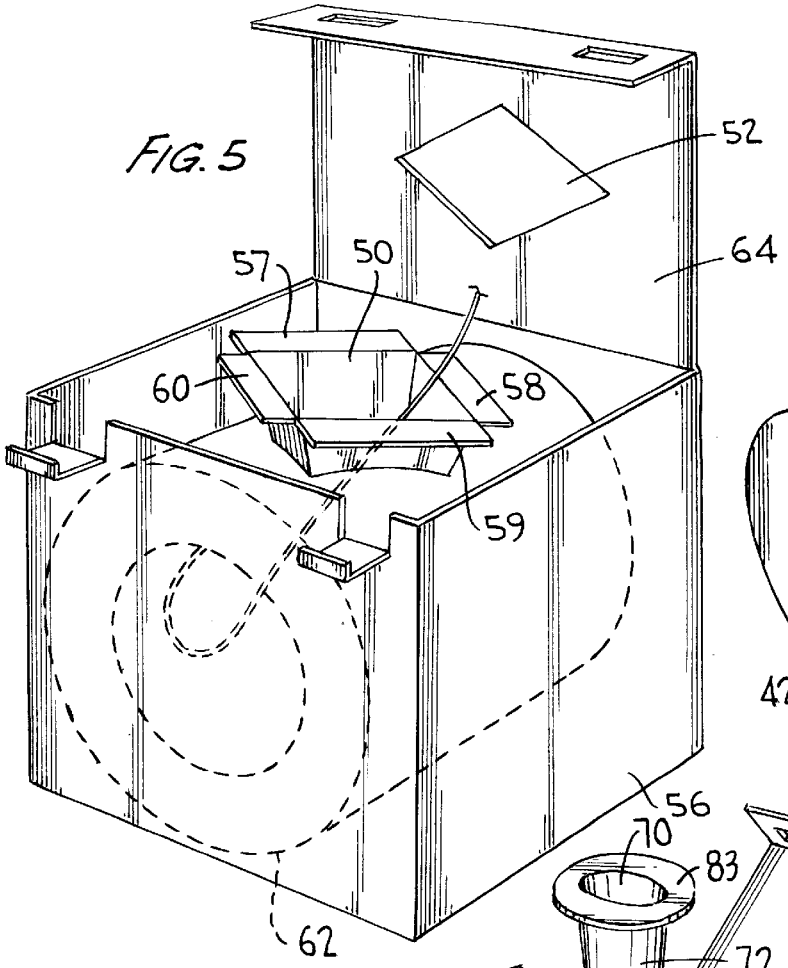
FIG. 5 illustrates a payout "tube" that is the preferred embodiment of the invention and comprises a diamond-shaped payout hole and "tube" and is folded out of corrugated package material and wherein the flaps of the corrugated package trap the payout guide.

FIG. 5 shows the preferred embodiment of the payout hole and payout tube in accordance with the invention. The diamond cross section of the payout tube 50 is the same general shape as the payout hole 52, and is made of folded corrugated cardboard material. This provides a very inexpensive payout system. The payout tube 50 is tapered as shown at 54 to allow the coil or cable the freedom to slide toward the center of the package 56.

In fact all of the large payout tubes (guides) are tapered for improved payout characteristics, and because this allows them to be stacked inside one another, they will take up less room during shipment. The flaps 57, 58, 59 and 60 are used to trap the payout tube 50 between the wound coil 62 and the top panel 64 of the package container 56 as shown in FIG. 5.

Figure 6:
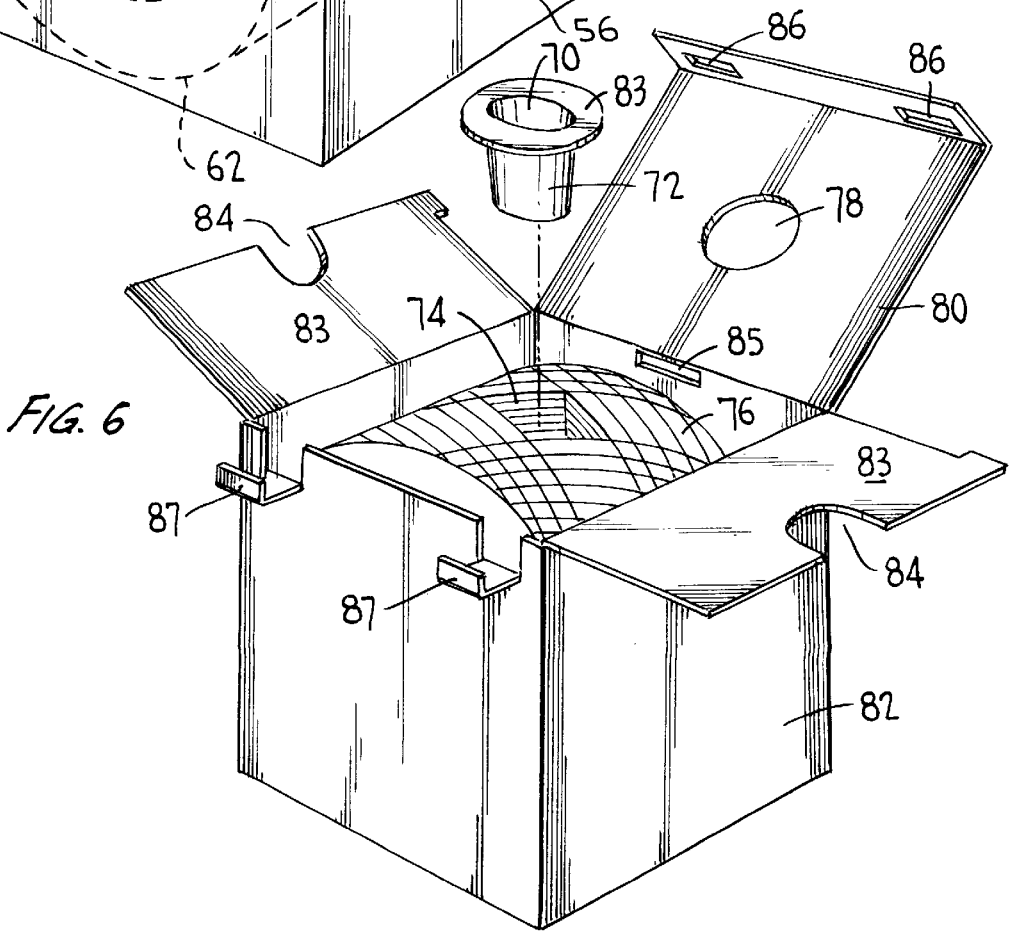
FIG. 6 represents a fourth embodiment of the invention in which a payout guide/tube of a round, oval or even diamond shape and wherein the guide/tube is retained by the closed side and top flaps of the container holding the wound coil.

FIG. 6 shows a further embodiment of the invention wherein the payout tube 70 is in the form of a "hat" in which the tube portion 72 has a tapered oval shape and extends into the payout hole 74 of the wound coil or cable 76. The payout tube 70 is passed through payout hole 78 in panel cover 80 of package container 82 from the outside of the cover so that rim 83 of the payout tube 70 rests against the surface of the panel cover 80.

With payout tube 70 inserted into payout hole 78 and rim 83 resting against the outside surface of panel cover 80, the side panels 83 are closed so that openings 84 surround the payout tube 70 and panel cover 80 is closed with tube portion 72 engaged in payout hole 74 of the wound coil 76 in container 82. Tabs 87 are then inserted into slots 86 in the panel cover 80 to secure it and the payout tube 70 in place.

The embodiment of FIG. 6 does not require cones for guiding the wound cable or coil from the payout hole 74 to the payout tube 70, and in particular the tube portion 72 thereof, because the twist that exists in the coil or cable causes the coil or cable to rotate during payout, and the cones hinder this process.

The wound coils or cable are produced with payout holes of in excess of 90 degrees of circumference. This is easily accomplished using any one of Windings, Inc.'s winding machines in existence (for example, see Windings, Inc.'s U.S. Pat. No. 4,406,419 and/or U.S. Pat. No. 5,678,778).

The hole slant is corrected and the constant hole size is adjusted for using the methods described in the Windings, Inc.'s U.S. Pat. No. 5,470,026 for generating a uniform width payout hole.

Figure 7B:
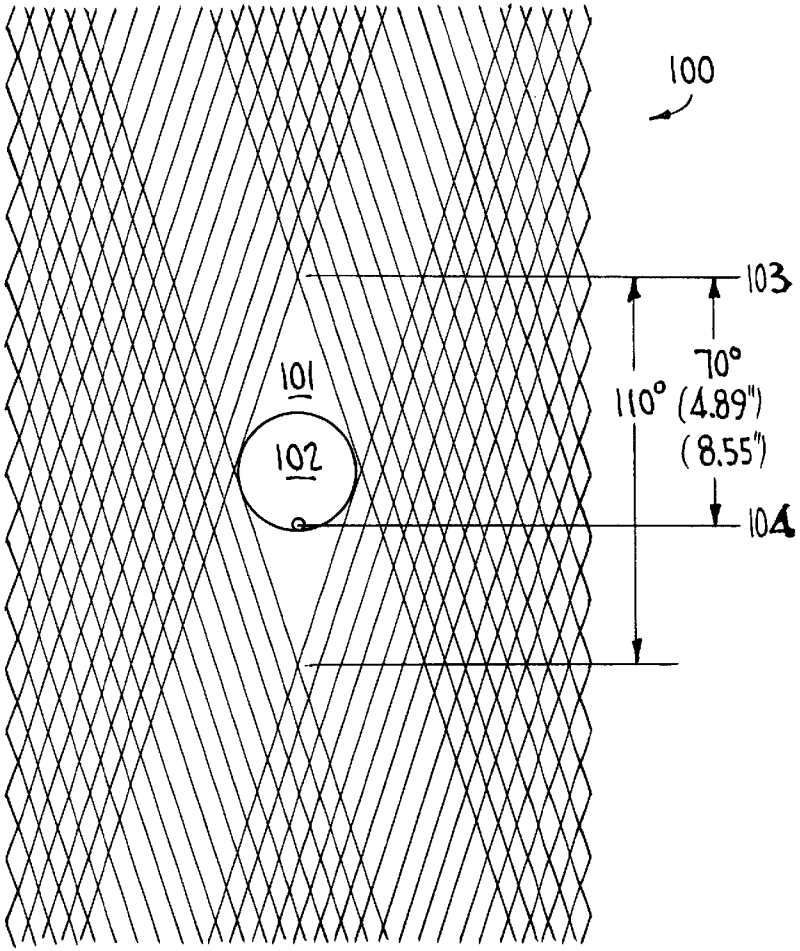
FIGS. 7A–7D illustrate different coils with various shaped guides/tubes in accordance with the invention and wherein a center portion of the coil is shown laid out flat.
Figure 7A:
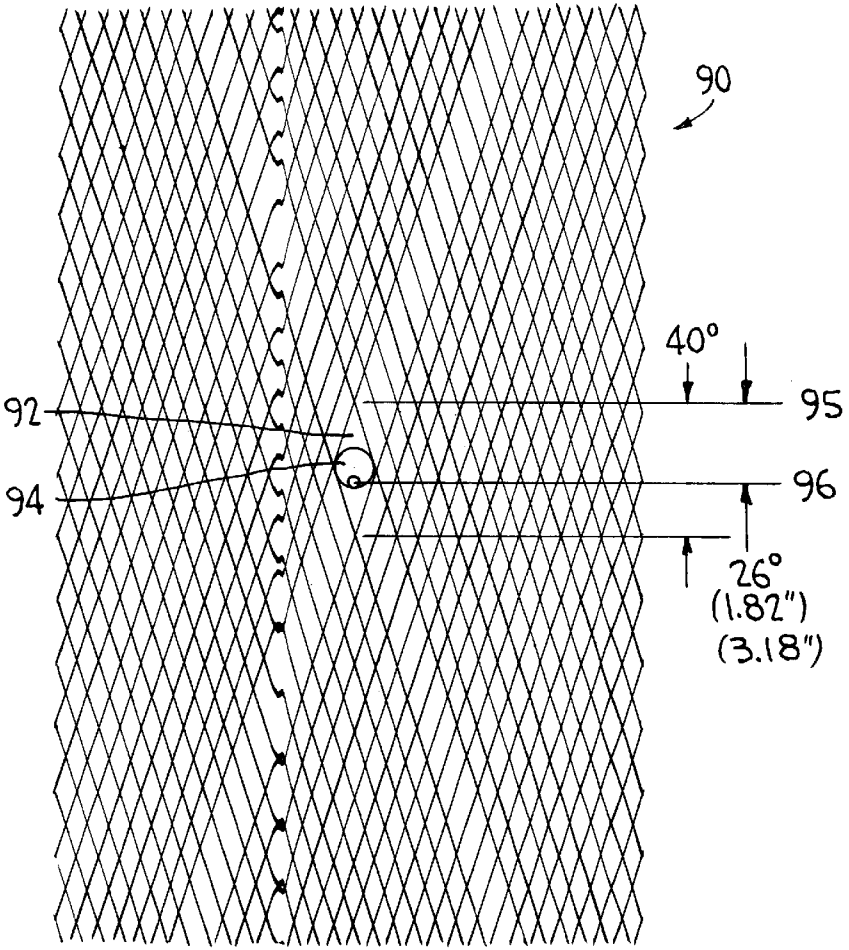

The wound coil 90 shown in FIG. 7A has a 40 degree payout hole 92 with a 1 inch OD payout tube 94. The distance between the top cross-over 95 and the exit point 96 is approximately 26 degrees as illustrated in the FIG. 7*a*. This subtends a coil arc of 1.82 inches on an 8 inch mandrel and a 3.18 inch coil arc at 14 inches (14 inches is chosen because this is the nominal size for CAT5–CAT7 unshielded cables).

The wound coil 100 shown in FIG. 7B has a payout hole 101 of 110 degrees using a round payout tube/guide 102 of approximately 2.75 inches. The crossover 103 and exit point 104 distance is 70 degrees which corresponds to coil arcs of 4.89 inches and 8.55 inches for an 8 inch mandrel and a 14 inch coil, respectively.

Figure 7D:
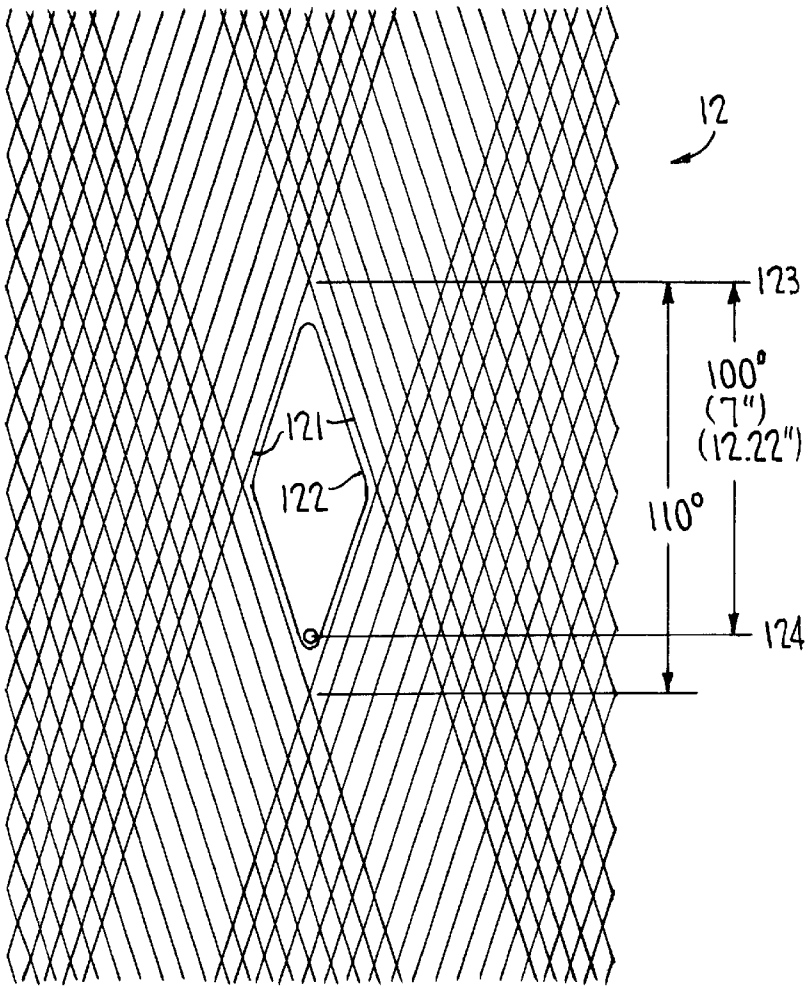
Figure 7C:
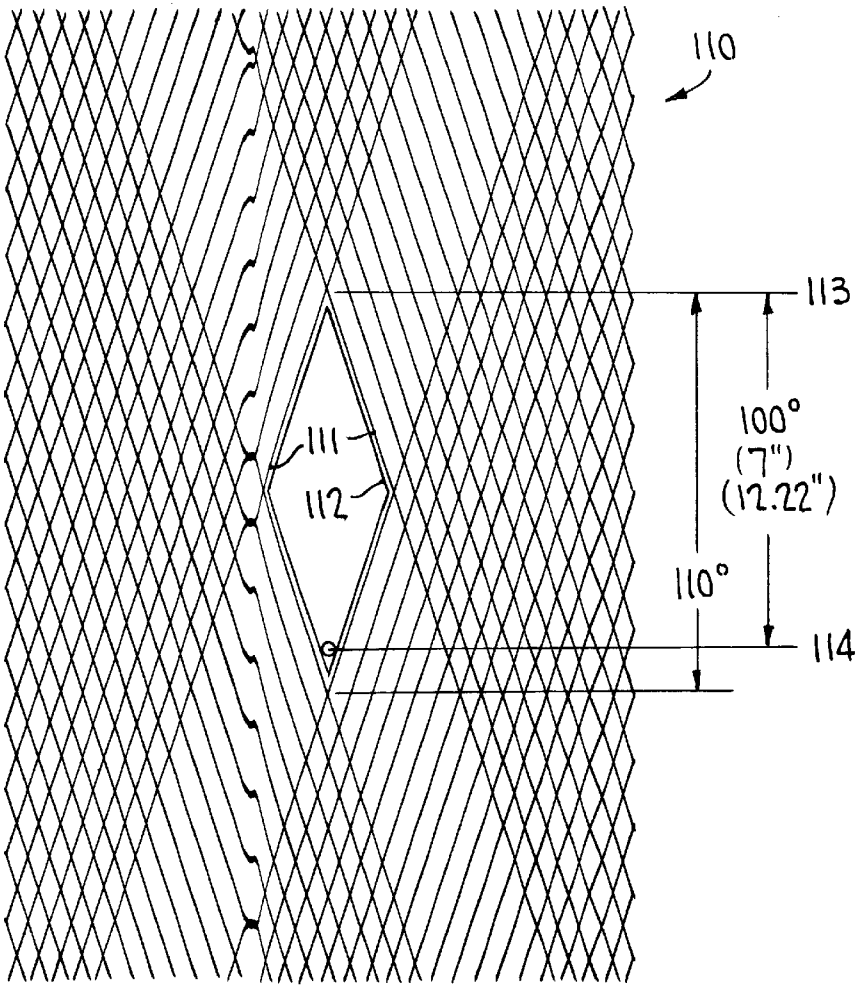

The wound coil 110 shown in FIG. 7C has a diamond-shaped hole 111 of 110 degrees and includes a diamond-shaped payout guide 112. The crossover 113 and exit point 114 distance is 100 degrees which corresponds to coil arcs of 7 inches and 12.22 inches for an 8 inch mandrel and a 14 inch coil, respectively.

The wound coil 120 shown in FIG. 7D has a payout hole 121 of 110 degrees and uses a generally oval-shaped guide 122. The crossover 123 and exit point 124 distance is 100 degrees which corresponds to coil arcs of 7 inches and 12.22 inches for an 8 inch mandrel and 14 inch coil, respectively.

It is apparent that, since the distance from the exit point and the crossovers nearest the payout hole are greatly increased, the filamentary material (cable or wire) does not have to experience anywhere as much bending stress with a larger than nominal hole and guide in accordance with the method of the invention. Moreover, the larger than nominal payout hole/tube of the invention is better than the nominal prior art-sized payout holes/tubes for many electronic and fiber optic cables as the bending radius of the coil is increased over that afforded by prior art winding techniques. Furthermore, the payout is also much smoother because the bending forces are much lower. With the smaller payout hole and tube, as the bending radius decreases, and the forces increase, the cable tends to spring free from the coil wall, placing many loops in the path of the exiting cable. This is reduced (or even eliminated) with the large hole. This is all in addition to the twist that is allowed to exit the package.

Therefore, it is desired that the present invention not be limited to the embodiments specifically described, but that it include any and all such modifications and variations that would be obvious to those skilled in this art. It is our intention that the scope of the present invention should be determined by any and all such equivalents of the various terms and structure as recited in the following annexed claims.

We claim:

1. A payout tube for enabling payout of filamentary material having inherent twist characteristics from a coil of the filamentary material wound in a figure 8 configuration with a payout hole extending from the inner layer to the outer layer of said coil, comprising:

the payout hole having an oval shape;

an inner end of the payout tube being adapted for insertion into the payout hole and having an oval shape corresponding to the oval shape of the payout hole, said payout hole having a diameter of at least ninety degrees;

the payout tube having an inner diameter increasing in size from said inner end to said outer end; and a collar formed around the outer end to support the payout tube against the outer surface of a container containing the wound coil.

2. A payout tube for enabling payout of filamentary material having inherent twist characteristics from a coil of the filamentary material wound in a figure 8 configuration with a payout hole extending from the inner layer to the outer layer of said coil, comprising:

a container in which the wound coil is packaged and having a hingeable panel, said panel including a diamond-shaped opening;

a payout tube formed of container-type material and having an outer end opening conforming to the diamond-shaped opening in said panel, said payout tube including a flap member extending from each of the sides of the diamond shaped opening and extending through and around the edges of the diamond-shaped opening in the panel for supporting the payout tube with the panel in a closed position;

the payout hole in the wound coil having a diamond-shaped opening with a diameter greater than ninety degrees; and said payout tube having an inner end having a diamond-shaped opening for extending into the diamond-shaped opening of the payout hole.

3. A payout tube for enabling payout of filamentary material having inherent twist characteristics from a coil of the filamentary material wound in a figure 8 configuration with a payout hole extending from the inner layer to the outer layer of said coil, comprising:

a container in which the wound coil is packaged and having a hingeable panel, said panel including an oval-shaped opening;

a payout tube formed having an outer end opening conforming to the oval-shaped opening in said panel, said outer end being formed in an oval-shaped collar the periphery of which is adapted to be supported on the outer periphery of the oval-shaped opening in the panel with the panel in a closed position;

the payout hole in the wound coil having an oval-shaped opening with a diameter greater than ninety degrees; and said payout tube having an inner end with an oval-shaped opening for extending into the oval-shaped opening of the payout hole.

4. The payout tube according to claim 3, wherein the container further comprises opposed hinged side panels each having a portion thereof with a cut portion for supporting said collar with the side panels in a closed position.

5. A wound coil of filamentary material having inherent twist characteristics and wound in a figure 8 configuration with a payout hole extending from the inner layer to the outer layer of the coil, comprising:

the coil crossovers are at least 45 degrees removed from the center of the payout hole, thereby increasing the bend radius of the wound coil; and the distance from the crossovers and the exit point of the wound coil from the payout hole is increased to approximately 70 degrees.

6. The wound coil according to claim 5, wherein the payout hole is cylindrically-shaped.

7. The wound coil according to claim 5, wherein the payout hole is diamond-shaped.

8. The wound coil according to claim 5, wherein the payout hole is oval-shaped.

9. The wound coil according to claim 5, further comprising a payout tube having a cylindrical shape and inserted in said payout hole.

10. The wound coil according to claim 6, further comprising a payout tube having a cylindrical shape and inserted in said payout hole.

11. The wound coil according to claim 7, further comprising a payout tube having a diamond shape conforming to the diamond shape of the payout hole and inserted in said payout hole.

12. The wound coil according to claim 8, further comprising a payout tube having an oval shape conforming to the oval shape of said payout hole and inserted in said payout hole.

13. A wound coil of filamentary material having inherent twist characteristics and wound in a figure 8 configuration with a payout hole extending from the inner layer to the outer layer of the coil, comprising:

a payout hole having a diameter of at least 40 degrees;

the distance between the top crossover and the exit point of the coil from the payout hole is approximately 26 degrees;

a coil arc of approximately 1.82 inches on an eight inch mandrel and a coil arc of approximately 3.18 inches at a 14 inch diameter of the wound coil.

14. The wound coil of claim 13, further comprising a payout tube of approximately 1 inch.

15. A wound coil of filamentary material having inherent twist characteristics and wound in a figure 8 configuration with a payout hole extending from the inner layer to the outer layer of the coil, comprising:

a payout hole having a diameter of at least 110 degrees;

the distance between the top crossover and the exit point of the coil from the payout hole is approximately 70 degrees;

a coil arc of approximately 4.89 inches on an eight inch mandrel and a coil arc of approximately 8.55 inches at a 14 inch diameter of the wound coil.

16. The wound coil of claim 15, further comprising a round payout tube having an OD of approximately 2.75 inches.

17. A wound coil of filamentary material having inherent twist characteristics and wound in a figure 8 configuration with a payout hole extending from the inner layer to the outer layer of the coil, comprising:

a payout hole having a diameter of at least 110 degrees;

the distance between the top crossover and the exit point of the coil from the payout hole is approximately 100 degrees;

a coil arc of approximately 7.00 inches on an eight inch mandrel and a coil arc of approximately 12.22 inches at a 14 inch diameter of the wound coil.

18. The wound coil of claim 17, further comprising a payout tube having a diamond shape.

19. A wound coil of filamentary material having inherent twist characteristics and wound in a figure 8 configuration with a payout hole extending from the inner layer to the outer layer of the coil, comprising:

a payout hole having a diameter of at least 110 degrees;

the distance between the top crossover and the exit point of the coil from the payout hole is approximately 100 degrees;

a coil arc of approximately 7.00 inches on an eight inch mandrel and a coil arc of 12.22 inches at a 14 inch diameter of the wound coil.

20. The wound coil of claim 19, further comprising a payout tube having an oval shape.

* * * * *